US011131057B2

(12) United States Patent
Ahamad et al.

(10) Patent No.: US 11,131,057 B2
(45) Date of Patent: Sep. 28, 2021

(54) LAUNDRY TREATING APPLIANCE HAVING A HINGE ASSEMBLY

(71) Applicant: WHIRLPOOL CORPORATION, Benton Harbor, MI (US)

(72) Inventors: Iftkhar Ahamad, Pune (IN); Raghavendran Prabhakaran, Chennai (IN); Neyda Eliza Leon Lopez, Santa Catarina (MX)

(73) Assignee: Whirlpool Corporation, Benton Harbor, MI (US)

( * ) Notice: Subject to any disclaimer, the term of this patent is extended or adjusted under 35 U.S.C. 154(b) by 165 days.

(21) Appl. No.: 16/509,531

(22) Filed: Jul. 12, 2019

(65) Prior Publication Data

US 2021/0010190 A1 Jan. 14, 2021

(51) Int. Cl.

| | |
|---|---|
| ***D06F 39/14*** | (2006.01) |
| ***E05F 3/10*** | (2006.01) |
| ***E05D 3/02*** | (2006.01) |
| ***E05F 3/20*** | (2006.01) |

(52) U.S. Cl.

CPC ..... *D06F 39/14* (2013.01); *E05D 3/02* (2013.01); *E05F 3/104* (2013.01); *E05F 3/20* (2013.01); *E05Y 2201/212* (2013.01); *E05Y 2900/312* (2013.01)

(58) Field of Classification Search

CPC .... E05F 3/20; E05F 3/104; E05D 3/02; D06F 39/14; E05Y 2201/212; E05Y 2900/312

See application file for complete search history.

(56) References Cited

U.S. PATENT DOCUMENTS

| | | | | |
|---|---|---|---|---|
| 2,892,209 | A * | 6/1959 | Condit | E05D 11/1014 16/321 |
| 2,899,717 | A * | 8/1959 | Billings et al. | E05D 15/505 49/193 |
| 2,936,892 | A * | 5/1960 | Mcneil | E05B 47/0607 210/146 |
| 4,914,781 | A | 4/1990 | Sokn et al. | |
| 6,766,563 | B2 | 7/2004 | Lee | |
| 8,186,782 | B2 | 3/2012 | Choi | |
| 9,080,365 | B2 | 7/2015 | Collene et al. | |

(Continued)

FOREIGN PATENT DOCUMENTS

| | | | | |
|---|---|---|---|---|
| WO | 2018042962 | A1 | 3/2018 | |
| WO | WO-2018042962 | A1 * | 3/2018 | D06F 37/28 |

OTHER PUBLICATIONS

Machine Translation of WO 2018042962 to Izawa et al., Mar. 2018. (Year: 2018).*

*Primary Examiner* — Benjamin L Osterhout

(74) *Attorney, Agent, or Firm* — McGarry Bair PC

(57) ABSTRACT

A laundry treating appliance for treating laundry items according to an automatic cycle of operation can include a cabinet defining an interior and having a top panel that at least partially defines an access opening to the interior. A lid is rotatable between a closed position and an opened position to selectively open or close the access opening. At least one hinge assembly couples the top panel with the lid. The at least one hinge assembly can include a hinge housing coupled to the top panel. A cam is received within the hinge housing and coupled to the lid. A snubber housing is coupled to the hinge housing and has a damper receiving portion. A damper is at least partially received within the damper receiving portion.

19 Claims, 13 Drawing Sheets

(56) References Cited

U.S. PATENT DOCUMENTS

| | | | | |
|---|---|---|---|---|
| 9,316,036 | B2 | 4/2016 | Collene et al. | |
| 9,464,376 | B2 | 10/2016 | Kim | |
| 9,598,811 | B2 | 3/2017 | Lee et al. | |
| 2011/0050060 | A1* | 3/2011 | Kim | D06F 37/42 312/228 |
| 2011/0062837 | A1* | 3/2011 | Kim | D06F 23/04 312/228 |
| 2011/0094056 | A1 | 4/2011 | Lautenschlager | |
| 2014/0116097 | A1* | 5/2014 | Park | D06F 39/14 68/196 |
| 2016/0230438 | A1 | 8/2016 | Collene et al. | |
| 2017/0122020 | A1 | 5/2017 | Collene | |
| 2017/0130502 | A1 | 5/2017 | Collene | |
| 2018/0238093 | A1* | 8/2018 | Rommelmann | E05F 5/02 |

* cited by examiner

LAUNDRY TREATING APPLIANCE HAVING A HINGE ASSEMBLY

BACKGROUND

Laundry treating appliances, such as clothes washers, clothes dryers, washing machines, refreshers, and non-aqueous systems, can have a configuration based on a container, such as a laundry basket or drum that defines a drum opening, which may or may not rotate, and that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, or detergents, can be supplied to the treating chamber in accordance with the cycle of operation.

The laundry treating appliance can include a cabinet including a panel with an access opening through which laundry items can be loaded and unloaded into the treating chamber. A closure, door assembly, or lid can be movably mounted to the cabinet to selectively open and close the access opening to the treating chamber. The lid can include multiple door pieces to support various parts of the lid, such as a transparent or partially transparent viewing window, or a hinge assembly for movably mounting the lid to the cabinet.

BRIEF SUMMARY

In one aspect, the present disclosure relates to a laundry treating appliance for treating laundry items according to an automatic cycle of operation, the laundry treating appliance comprising a cabinet defining an interior and having a top panel that at least partially defines an access opening to the interior, a lid rotatable between a closed position and an opened position to selectively open or close the access opening, and at least one hinge assembly coupling the top panel with the lid, the at least one hinge assembly comprising a hinge housing coupled to the top panel, a cam received within the hinge housing and coupled to the lid, a snubber housing coupled to the hinge housing and having a damper receiving portion provided at a non-zero angle relative to the top panel in the closed position, and a damper at least partially received within the damper receiving portion and biased against the cam such that movement of the cam selectively depresses the damper when the lid moves from the opened position to the closed position.

In another aspect, the present disclosure relates to a laundry treating appliance for treating laundry items according to an automatic cycle of operation, the laundry treating appliance comprising a cabinet defining an interior and having a top panel that at least partially defines an access opening to the interior, a lid rotatable between a closed position and an opened position to selectively open or close the access opening, and at least one hinge assembly coupling the top panel with the lid, the at least one hinge assembly comprising a hinge housing coupled to the top panel, a cam received within the hinge housing and coupled to the lid, a snubber housing coupled to the hinge housing and having a damper receiving portion, a damper at least partially received within the damper receiving portion and at least partially underlying the top panel when the lid is in the opened position, and a piston provided between the cam and the damper and at least partially underlying the lid when the lid is in the opened position, the piston biased against the cam by the damper such that movement of the cam causes the piston to selectively depress the damper when the lid moves from the opened position to the closed position.

DETAILED DESCRIPTION

Figure 1:
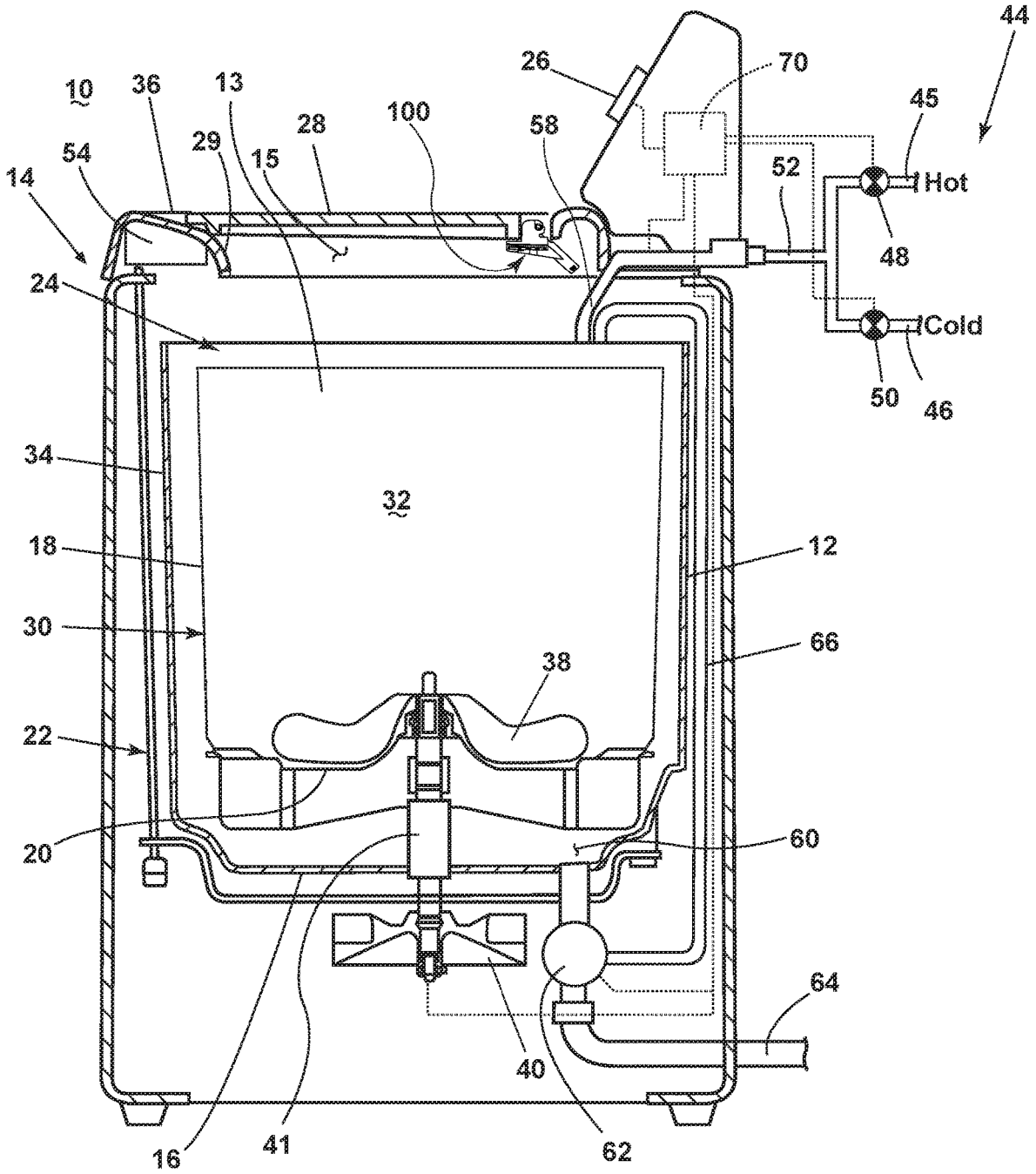
FIG. 1 is a schematic cross-sectional view of a laundry treating appliance including a cabinet and a lid in a closed position.

FIG. 1 illustrates a schematic view of a laundry treating appliance 10 according to aspects of the present disclosure. The laundry treating appliance 10 can be any laundry treating appliance 10 that performs a cycle of operation to clean or otherwise treat laundry items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 is illustrated herein as a vertical axis, top-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum may rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 14, which defines a housing and an interior, within which a laundry holding assembly resides. The cabinet 14 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated exemplary laundry treating appliance 10 can include a rotatable basket 30 having an open top 13 that can be disposed within the interior of the cabinet 14 and can at least partially define a rotatable treating chamber 32 for receiving laundry items for treatment and an access opening 15. The access opening 15 can provide access to the treating chamber 32. The treating chamber 32 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket.

The open top 13 can be aligned with the access opening 15. A tub 34 can also be positioned within the cabinet 14 and can define an interior 24 within which the basket 30 can be positioned. The tub 34 can also at least partially define at least a portion of the treating chamber 32. The tub 34 can have a generally cylindrical side or tub peripheral wall 12 closed at its bottom end by a base 16 that can at least partially define a sump 60. The tub 34 can be at least partially aligned with the access opening 15 and the open top 13. In one example, the tub 34, the basket 30, along with the open top 13, and the access opening 15, can have central axes that are co-axial with one another, or with at least one of the other axes, such that a common central axis is formed.

The basket 30 can have a generally peripheral side wall 18, which is illustrated as a cylindrical side wall, closed at the basket end by a basket base 20 to further at least partially define the treating chamber 32. The basket 30 can be rotatably mounted within the tub 34 for rotation about a vertical basket axis of rotation and can include a plurality of perforations (not shown), such that liquid can flow between the tub 34 and the rotatable basket 30 through the perforations (not shown). While the illustrated laundry treating appliance 10 includes both the tub 34 and the basket 30, with the basket 30 at least partially defining the treating chamber 32, it is also within the scope of the present disclosure for the laundry holding assembly to include only one receptacle, such as the tub 34, without the basket 30, with the receptacle defining the laundry treating chamber 32 for receiving the load to be treated.

The cabinet 14 can further define a top wall or top panel 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34.

A selectively openable closure or cover, illustrated herein as comprising a lid 28, can be movably mounted to or coupled to the cabinet 14 for selective movement between an opened position (FIG. 6) and a closed position, as shown, to selectively open and close the access opening 15, respectively, and to selectively provide access into the laundry treating chamber 32 through the access opening 15 of the basket 30. In one example, the lid 28 can be rotatable between the closed position and the opened position relative to the cabinet 14. By way of non-limiting example, the lid 28 can be hingedly coupled to the cabinet 14 for movement between the opened position and the closed position. At least one hinge assembly 100 can couple the top panel 36 with the lid 28. In the closed position, the lid 28 can seal against at least one of the access opening 15, the top panel 36, or the shroud 29 and can at least partially confront the treating chamber 32 when the lid 28 closes the access opening 15. In the opened position, the lid 28 can be spaced apart from the access opening 15, the top panel 36, or the shroud 29 and can allow access to the top panel 36 and the access opening 15.

A laundry mover 38 can be rotatably mounted within the basket 30 to impart mechanical agitation to a load of laundry items placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the laundry mover 38 can be driven, such as to rotate within the tub 34, by a drive assembly 40 that includes a motor 41, which can include a gear case, operably coupled with the basket 30 and laundry mover 38. The motor 41 can be a brushless permanent magnet (BPM) motor having a stator (not shown) and a rotor (not shown). Alternately, the motor 41 can be coupled to the basket 30 through a belt and a drive shaft to rotate the basket 30, as is known in the art. Other motors, such as an induction motor or a permanent split capacitor (PSC) motor, can also be used. The motor 41 can rotate the basket 30 at various speeds in either rotational direction about the vertical axis of rotation during a cycle of operation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive assembly 40 and can selectively operably couple the motor 41 with either the basket 30 and/or the laundry mover 38.

A suspension assembly 22 can dynamically hold the tub 34 within the cabinet 14. The suspension assembly 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension assembly 22.

The laundry treating appliance 10 can further include a liquid supply assembly to provide liquid, such as water or a combination of water and one or more wash aids, such as detergent, into the treating chamber 32 for use in treating laundry items during a cycle of operation. The liquid supply assembly can include a water supply 44 configured to supply hot or cold water. The water supply 44 can include a hot water inlet 45 and a cold water inlet 46. A valve assembly can include a hot water valve 48, a cold water valve 50, and various conduits 52, 58 for selectively distributing the water supply 44 from the hot water and cold water inlets 45, 46. The valves 48, 50 are selectively openable to provide water from a source of water, such as from a household water supply (not shown) to the conduit 52. A second water conduit, illustrated as the water inlet 58, can also be fluidly coupled with the conduit 52 such that water can be supplied directly to the treating chamber 32 through the open top of the basket 30. The water inlet 58 can be configured to dispense water, and optionally treating chemistry, into the tub 34 in a desired pattern and under a desired amount of pressure. For example, the water inlet 58 can be configured to dispense a flow or stream of treating chemistry or water into the tub 34 by gravity, i.e. a non-pressurized stream. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A treating chemistry dispenser 54 can be provided for dispensing treating chemistry to the basket 30 for use in treating the laundry items according to a cycle of operation, either directly or mixed with water from the water supply 44. The treating chemistry dispenser 54 can be a single use dispenser, a bulk dispenser, or a combination of or an integrated single use and bulk dispenser, in non-limiting examples, and is fluidly coupled to the treating chamber 32. While the treating chemistry dispenser 54 is illustrated herein as being provided at the top panel 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e. a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply assembly and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid.

A liquid recirculation and drain assembly can be provided with the laundry treating appliance 10 for recirculating liquid from within the laundry holding assembly and draining liquid from the laundry treating appliance 10. Liquid supplied to the tub 34 or into the treating chamber 32 through the water inlet 58 and/or the treating chemistry dispenser 54 typically enters a space between the tub 34 and the basket 30 and can flow by gravity to the sump 60. More specifically, the sump 60 can be located in and formed in part by the bottom of the tub 34 and the liquid recirculation assembly can be configured to recirculate treating liquid from the sump 60 onto the top of a laundry load located in the treating chamber 32.

A pump 62 can be housed below the tub 34 and can have an inlet fluidly coupled with the sump 60 and an outlet configured to fluidly couple and to direct liquid to either or both a household drain 64, which can drain the liquid from the laundry treating appliance 10, or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid from the recirculation conduit 66 into the open top of the basket 30. The recirculation conduit 66 can introduce the liquid into the basket 30 in any suitable manner, such as by spraying, dripping, or providing a steady flow of liquid. In this manner, liquid provided to the tub 34, with or without treating chemistry can be recirculated into the treating chamber 32 for treating the laundry within. The liquid recirculation and drain assembly can include other types of recirculation assemblies.

It is noted that the illustrated drive assembly, suspension assembly, liquid supply assembly, recirculation and drain assembly, and dispensing assembly are shown for exemplary purposes only and are not limited to the assemblies shown in the drawings and described above. For example, the liquid supply and recirculation and pump assemblies can differ from the configuration shown in FIG. 1, such as by inclusion of other valves, conduits, sensors (such as liquid level sensors and temperature sensors), and the like, to control the flow of liquid through the laundry treating appliance 10 and for the introduction of more than one type of treating chemistry. For example, the liquid supply assembly can be configured to supply liquid into the interior of the basket 30 or into the interior of the tub 34 not occupied by the basket 30, such that liquid can be supplied directly to the tub 34 without having to travel through the basket 30. In another example, the liquid supply assembly can include a single valve for controlling the flow of water from the household water source. In another example, the recirculation and pump assembly can include two separate pumps for recirculation and draining, instead of the single pump 62 as previously described.

The laundry treating appliance 10, and specifically the liquid supply and/or recirculation and drain assemblies, can be provided with a heating assembly (not shown), which can include one or more devices for heating laundry and/or to heat liquid provided to the treating chamber 32 as part of a cycle of operation, such as, for example, a steam generator, which can be any suitable type of steam generator, such as a flow through steam generator or a tank-type steam generator, and/or a sump heater. Alternatively, the sump heater can be used to generate steam in place of or in addition to the steam generator. In one example, the heating assembly can include a heating element provided in the sump 60 to heat liquid that collects in the sump 60. Alternatively, the heating assembly can include an in-line heater that heats the liquid as it flows through the liquid supply, dispensing and/or recirculation assemblies.

The laundry treating appliance 10 can further include a control assembly, illustrated herein as a controller 70, for controlling the operation of the laundry treating appliance 10 and coupled with various working components of the laundry treating appliance 10 to control the operation of the working components and to implement one or more treating cycles of operation. The control assembly can include the controller 70 located within the cabinet 14 and a user interface 26 that can be operably coupled with the controller 70. The user interface 26 can provide an input and output function for the controller 70.

The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 70 to communicate with the user in a variety of ways. For example, the controller 70 can be configured to send a text message to the user, send an electronic mail to the user, or provide audio information to the user either through the laundry treating appliance 10 or utilizing another device such as a mobile phone.

The controller 70 can include the machine controller and any additional controllers provided for controlling any of the components of the laundry treating appliance 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the laundry treating appliance 10.

Figure 2:
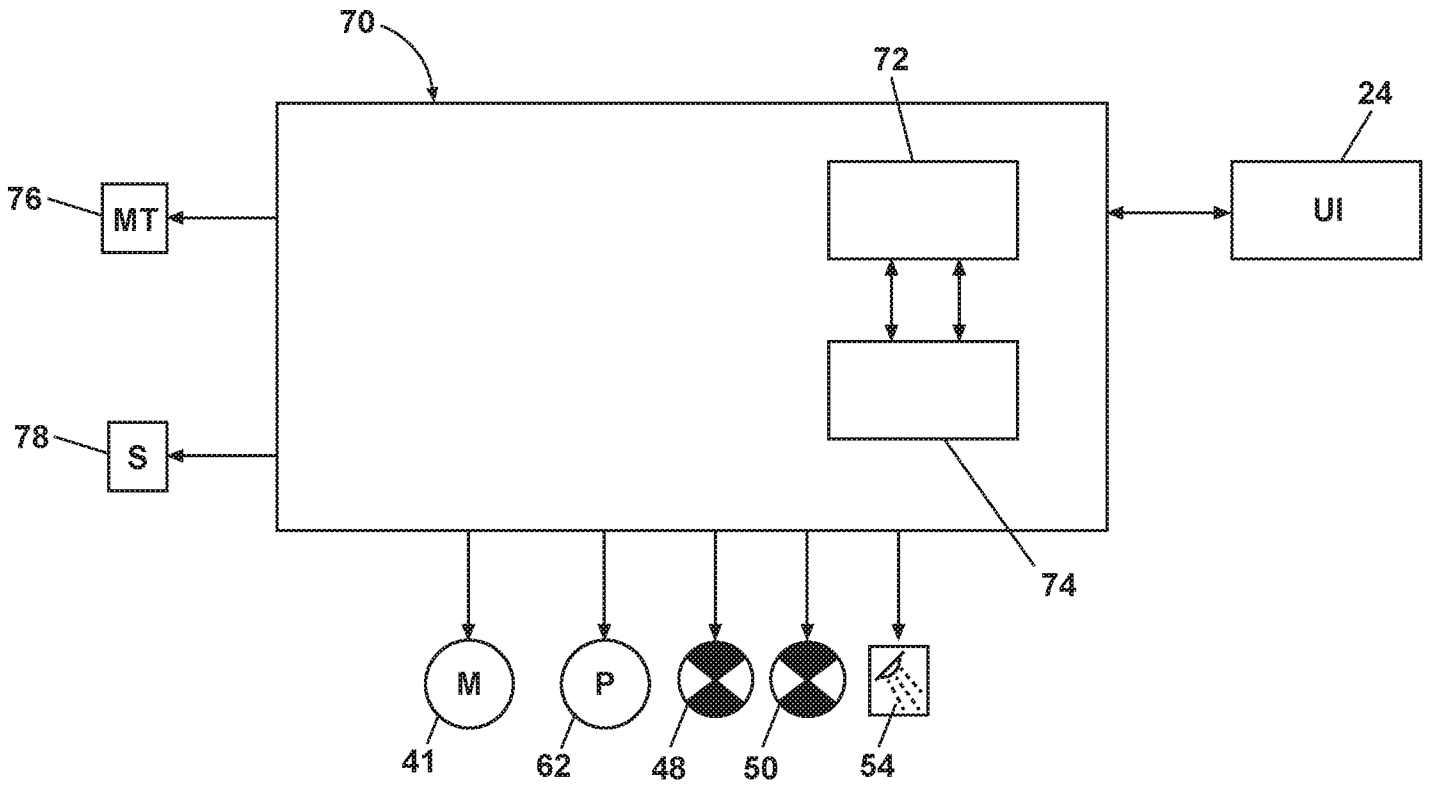
FIG. 2 is a schematic representation of a control assembly for controlling the operation of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the laundry treating appliance 10 and any additional software. For example, the memory 72 can store a set of executable instructions including at least one user-selectable cycle of operation. Examples, without limitation, of treating cycles of operation include: wash, heavy duty wash, delicate wash, quick wash, pre-wash, refresh, rinse only, and timed wash, which can be selected at the user interface 26. The memory 72 can also be used to store information, such as a database or table, and to store data received from the one or more components of the laundry treating appliance 10 that can be communicably coupled with the controller 70. The database or table can be used to store the various operating parameters for the one or more cycles of operation, including factory default values for the operating parameters and any adjustments to them by the control assembly or by user input.

The controller 70 can be operably coupled with one or more components of the laundry treating appliance 10 for communicating with and/or controlling the operation of the components to complete a cycle of operation. For example, the controller 70 can be coupled with the hot water valve 48, the cold water valve 50, and the dispenser 54 for controlling the temperature and flow rate of treating liquid into the treating chamber 32; the pump 62 for controlling the amount of treating liquid in the treating chamber 32 or sump 60; the drive assembly 40 at the motor 41 for controlling the direction and speed of rotation of the basket 30 and/or the laundry mover 38; the user interface 26 for receiving user selected inputs and communicating information to the user; and the heater assembly to control the operation of these and other components to implement one or more of the cycles of operation.

The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also be coupled with one or more sensors 78 provided in one or more of the assemblies of the laundry treating appliance 10 to receive input from the various additional sensors 78, which are known in the art and not shown for simplicity. Non-limiting examples of additional sensors 78 that can be communicably coupled with the controller 70 include a weight sensor, a moisture sensor, a chemical sensor, a position sensor, an imbalance sensor, a load size sensor, and a motor torque sensor, which can be used to determine a variety of assembly and laundry characteristics, such as laundry load inertia or mass.

Figure 3:
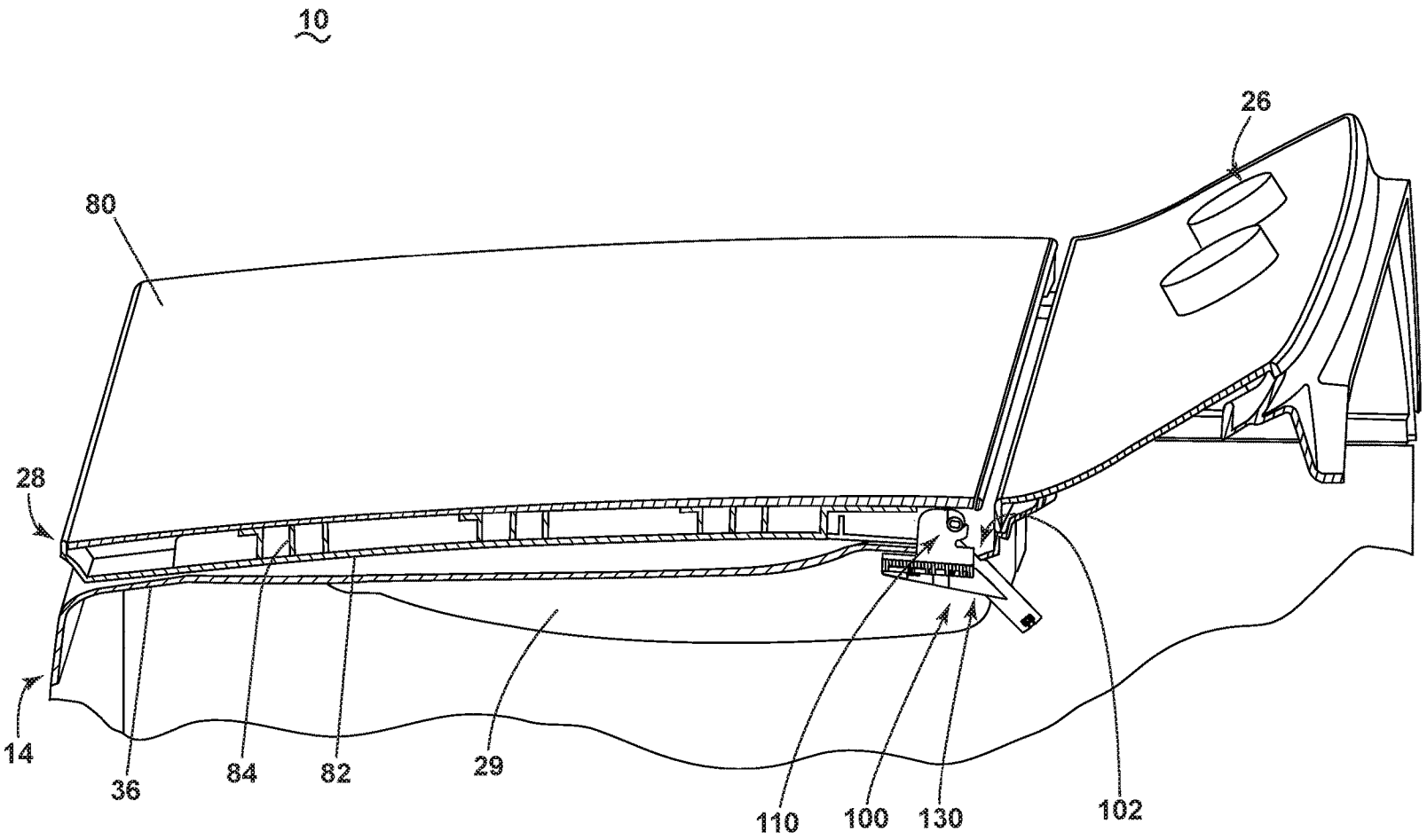
FIG. 3 is a cross-sectional view of the laundry treating appliance of FIG. 1 with the lid in the closed position and including a hinge assembly.

Referring now to FIG. 3, the lid 28 is shown in the closed position relative to the cabinet 14. As illustrated herein, the lid 28 can overlie and extend across the entire width and depth of the top panel 36, such as to form an edge-to-edge lid 28 and wherein the lid 28 can be provided entirely above the top panel 36, with no part of the lid 28 being provided in plane with or below the top panel 36. Alternatively, the lid 28 can be provided as, for example, an at least partially recessed lid wherein at least a portion of the lid 28 is recessed into the top panel 36 such that the top panel 36 surrounds and abuts at least a portion of a periphery of the lid 28. In either example, it will also be understood that the lid 28 can also overlie and extend across less than the entire width and the entire depth of the top panel 36. The lid 28 can comprise glass, metal, plastic, composite, or any other suitable material.

The lid 28 can further include a suitable closure assembly (not shown) to secure the lid 28 in the closed position. By way of non-limiting example, such a closure assembly can include a latch, a hook, or a snap mechanism provided on one of the lid 28 or the top panel 36 for selective engagement or coupling with the other of the lid 28 or the top panel 36. The closure assembly can be configured to resiliently retain the lid 28 in the closed condition until sufficient force is applied to overcome the coupling of the lid 28 with the top panel 36.

In one example, the lid 28 comprises an upper surface 80 and a lower surface 82 that can be vertically spaced from one another, such that the lower surface 82 at least partially confronts the treating chamber 32 when the lid 28 is in the closed position. Reinforcing structures 84 can be provided between the upper surface 80 and the lower surface 82 to provide improved stability to the lid 28. The reinforcing structures 84 can be provided as reinforcing ribs 84 that extend vertically, or substantially vertically, between the upper surface 80 and the lower surface 82. The hinge assembly 100 can be positioned such that, when the lid 28 is in the closed position, the hinge assembly 100 extends vertically above the lower surface 82, but is received below the upper surface 80 such that the upper surface 80 overlies at least a portion of the hinge assembly 100 and the hinge assembly 100 is hidden from view from the outside of the laundry treating appliance 10 when the lid 28 is in the closed position.

The at least one hinge assembly 100 rotatably couples the lid 28 with the top panel 36 and is coupled, mounted, or otherwise attached to both the lid 28 and the top panel 36. The top panel 36 of the cabinet 14 can define at least one hinge opening 102, such that at least a portion of the hinge assembly 100 can protrude upwardly through the hinge opening 102 to couple with the lid 28, while the rest of the hinge assembly 100 is received within the cabinet 14, below the top panel 36.

The hinge assembly 100 comprises a hinge portion 110, and can optionally include a damper portion 130. In one example, the at least one hinge assembly 100 can comprise first and second hinge assemblies 100, spaced vertically from one another such that the first hinge assembly 100 is positioned adjacent one edge of the lid 28 while the second hinge assembly 100 is positioned adjacent the opposite edge of the lid 28. In the case that first and second hinge assemblies 100 are provided opposite one another along edges of the lid 28, it is contemplated that the first and second hinge assemblies 100 can be provided as left and right hinge assemblies 100 that are structured so as to be flipped or mirror images to one another. It will be understood that the laundry treating appliance 10 can include any suitable number of hinge assemblies 100, including a single hinge assembly 100. While the lid 28 is illustrated herein as rotating about an axis of rotation at the rear of the top panel 36, it will be understood that the lid 28 can be configured to rotate about a rotation axis provided along any edge of the lid 28 and the top panel 36, such as the front or side.

Figure 4:
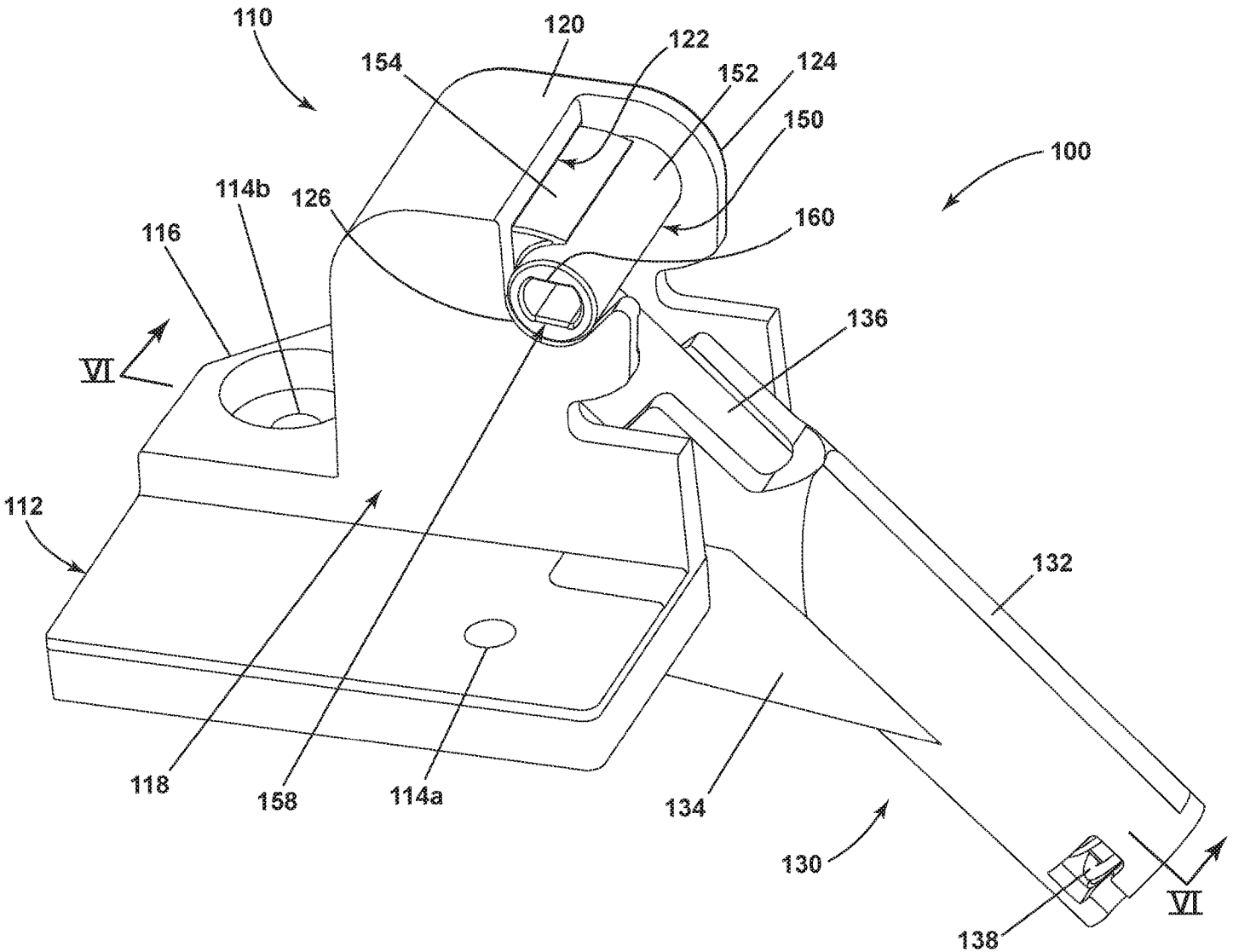
FIG. 4 is a top perspective view of the hinge assembly of FIG. 3 including a hinge housing and a snubber housing.

Referring now to FIG. 4, hinge portion 110 comprises a base 112 that can define, by way of non-limiting example, a square or rectangular lower footprint of the base 112. The base 112 can include at least one fastener opening 114, which can be provided as a base fastener opening **114*a* and a first damper fastener opening 114*b*. The base 112 can further define at least one angled edge 116 having the appearance of a corner having been removed from the base 112. The at least one angled edge 116 can be provided to allow the base 112 to be properly fit into the space constraints of the cabinet 14 and to minimize the space and cost of unnecessary material when manufacturing the hinge assembly 100. In one example, the angled edge 116 can be positioned adjacent the first damper fastener opening 114*b***.

The hinge portion 110 can further comprise a hinge housing 118. The hinge housing 118 extends upwardly from the base 112 and terminates at an upper surface 120 defined by the hinge housing 118. The hinge housing 118 defines an interior for receiving hinge components, including at least partially receiving the damper portion 130. The upper surface 120 can define a biasing surface 122 that is provided within the hinge housing 118 and confronts the interior of the hinge housing 118.

Figure 5:
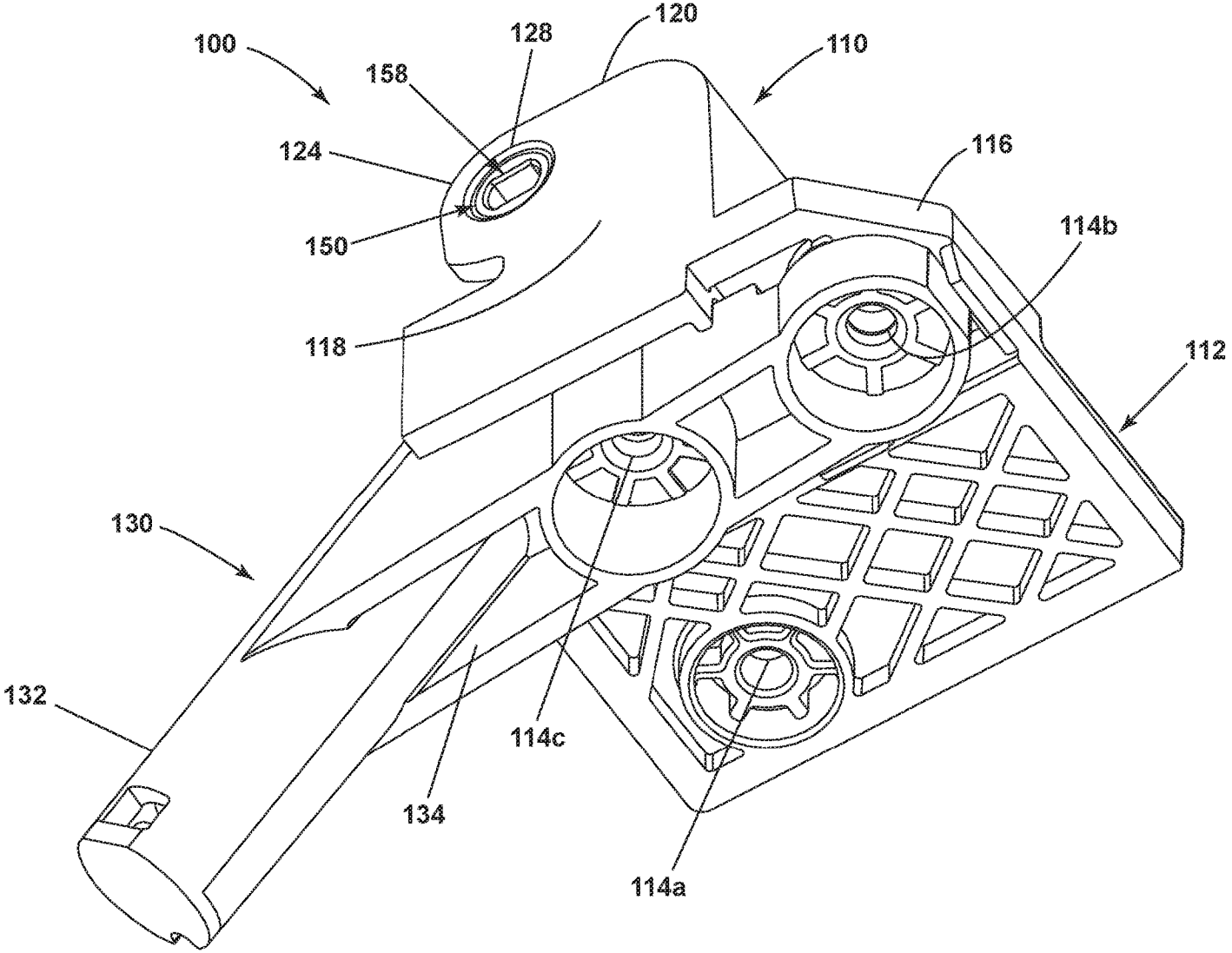
FIG. 5 is a bottom perspective view of the hinge assembly of FIG. 3.

The hinge housing 118 further comprises an inner hinge retaining structure 124 and an outer hinge retaining structure 126. Whether the hinge assembly 100 is a left or right hinge assembly 100, the inner hinge retaining structure 124 can be provided at the side of the hinge housing 118 that is laterally innermost from the edge of the lid 28, while the outer hinge retaining structure 126 is provided at the opposite side of the hinge housing 118 that is laterally outermost relative to the periphery of the lid 28. The inner hinge retaining structure 124 can comprise a portion of a sidewall of the hinge housing 118 and define a hinge aperture 128 (FIG. 5). The outer hinge retaining structure 126 can comprise, by way of non-limiting example, a rib, flange, support, shelf, or ledge that can have an open top so as to not completely define an enclosed aperture as does the hinge aperture 128.

A hinge cam 150 can be provided and at least partially supported by and resting on the outer hinge retaining structure 126. The hinge cam 150 comprises a lid hinge receiving portion 152 and a cam body 154 that extends from the lid hinge receiving portion 152. The hinge cam 150 can be at least partially received within the hinge housing 118 and is rotatable relative to and within the hinge housing 118. The lid hinge receiving portion 152 can be received by and coupled with the inner hinge retaining structure 124 and the outer hinge retaining structure 126, such that the lid hinge receiving portion 152 is partially received within the hinge aperture 128 (FIG. 5) and also partially received by, and, by way of non-limiting example, resting upon, the outer hinge retaining structure 126. The lid hinge receiving portion 152 defines a lid hinge channel 158 configured to receive at least a portion of a lid hinge 88 (FIG. 6) of the lid 28. The lid hinge channel 158 can include at least one key structure 160 to prevent rotation between the hinge cam 150 and the lid hinge 88 (FIG. 6) when they are coupled.

The damper portion 130 can be coupled to and at least partially received by the hinge housing 118. In one example, at least a portion of the damper portion 130 can be vertically lower than or below the hinge portion 110, such that the damper portion 130 is undermounted to and at least partially underlying the hinge housing 118. The damper portion 130 further comprises a mounting portion 134 configured to couple with the hinge portion 110, and, for example, to undermount to the hinge portion 110. The mounting portion 134 can also provide structural support and stability to the damper portion 130.

The damper portion 130 defines a snubber housing or a damper housing 132 that at least partially defines a damper receiving portion, and can also be undermounted to and at least partially underlying the hinge housing 118. The damper housing 132 can be provided at a non-zero angle relative to at least one of the base 112, the top panel 36, or the lid 28 when the lid 28 is in the closed position. By way of non-limiting example, the non-zero angle can be between 20 to 80 degrees; further 40 to 60 degrees; further 45 degrees.

A biasing body, illustrated herein as a piston 136, can be at least partially received within the damper housing 132 and can also protrude from the damper housing 132 to contact the hinge cam 150. A biasing element 138 can also be received within the damper housing 132 and configured to bias the piston 136 against the hinge cam 150. By way of non-limiting example, the biasing element 138 can be a spring, though it will be understood that any type of suitable biasing element can be used.

Referring now to FIG. 5, a portion of the lid hinge receiving portion 152 is shown to be received within the hinge aperture 128. The lid hinge receiving portion 152 can be sized and shaped so as to be resiliently retained within the hinge aperture 128 by the inner hinge retaining structure 124, such that the hinge aperture 128 defines a pivot point for rotatable movement of the hinge cam 150 relative to the hinge housing 118, and thus also for the lid 28 when the lid hinge 88 is received within the lid hinge receiving portion 152.

As illustrated herein, when the damper portion 130 is coupled with the hinge portion 110, the hinge portion 110 and the damper portion 130, and specifically the mounting portion 134, can collectively define the first damper fastener opening 114*b*, configured to receive a fastener 162 (FIG. 6) to couple the hinge portion 110 and the damper portion 130 together. Any suitable type of fastener 162 can be used, non-limiting examples of which include a screw, a bolt, a snap-in feature, a toggle, etc. The mounting portion 134 can further define a second damper fastener opening 114*c* configured to receive another fastener 162 to further secure the damper portion 130 to be undermounted to the hinge portion 110. It is contemplated that the damper portion 130 can be shaped, sized, and configured so as to not underlie the base fastener opening 114*a*, such that the base fastener opening 114*a* is configured to receive a fastener 162 to couple, and specifically to undermount, the hinge portion 110 to the top panel 36, but does not participate in the coupling of the damper portion 130 to the hinge portion 110. However, it will be understood that the number of fasteners 162 to be used for fastening the various components is not limiting, and any suitable number of fasteners 162 can be provided, including only a single fastener.

Figure 6:
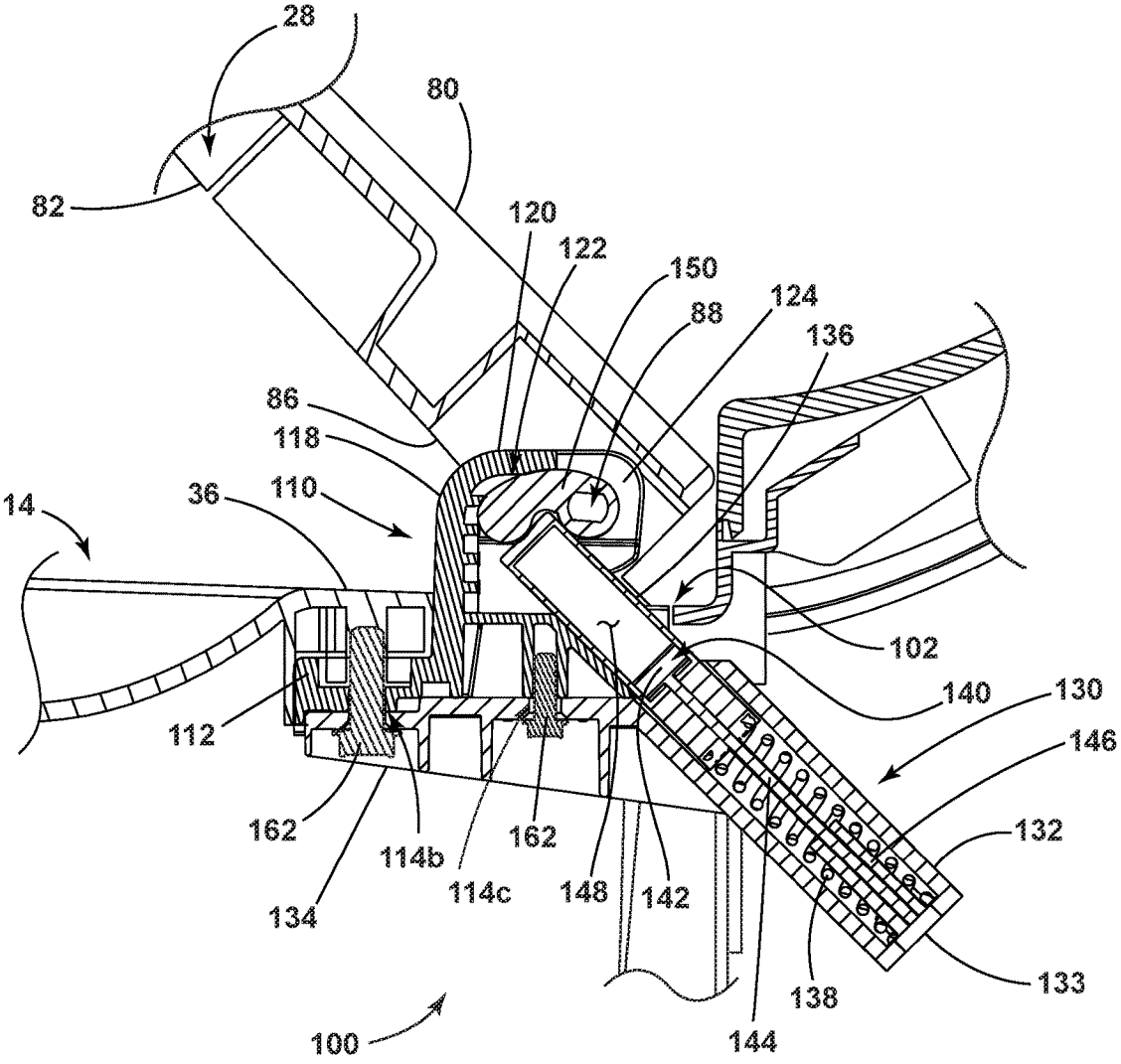
FIG. 6 is a cross-sectional view of the lid and the hinge assembly of FIG. 3 taken along line VI-VI of FIG. 4 and with the lid in the opened position.

Referring now to FIG. 6, the hinge assembly 100 couples the lid 28 to the top panel 36, with the lid 28 shown in the opened position. The hinge portion 110, including the hinge housing 118, is coupled to an underside of the top panel 36, and more specifically is undermounted to the top panel 36, such that at least a portion of the hinge housing 118 is received within and protrudes upwardly through the hinge opening 102. The damper portion 130, including the damper housing 132, is coupled to, and more specifically undermounted to, an underside of the hinge housing 118 and hinge portion 110, such that the damper portion 130 is in turn coupled to or undermounted to the top panel 36. Fasteners 162 can be received in each of the first and second damper fastener openings 114*b*, 114*c* to couple or undermount the damper portion 130, and more specifically the mounting portion 134, to the hinge portion 110, and then in turn to couple or undermount to the top panel 36. When the hinge assembly 100 is mounted to the to panel 36 as shown, the damper portion 130, and more specifically the damper housing 132, is undermounted to and can at least partially underlie the hinge portion 110, and more specifically the hinge housing 118, and is also at least partially positioned below the top panel 36.

The lid hinge 88 is coupled to the lid 28 such that the lid hinge 88 is fixed relative to the lid 28 and there is no rotational movement between the lid hinge 88 and the lid 28 such that the lid hinge 88 defines the axis of rotation of the lid 28. The lid hinge 88 can be coupled to any suitable portion of the lid 28, including to at least one of the upper surface 80, the lower surface 82, any of the reinforcing structures 84, or to a hinge mounting portion 86. The hinge mounting portion 86 can be positioned adjacent the hinge assembly 100 and can be at least partially received in the vertical space between the upper surface 80 and the lower surface 82.

Figure 7:
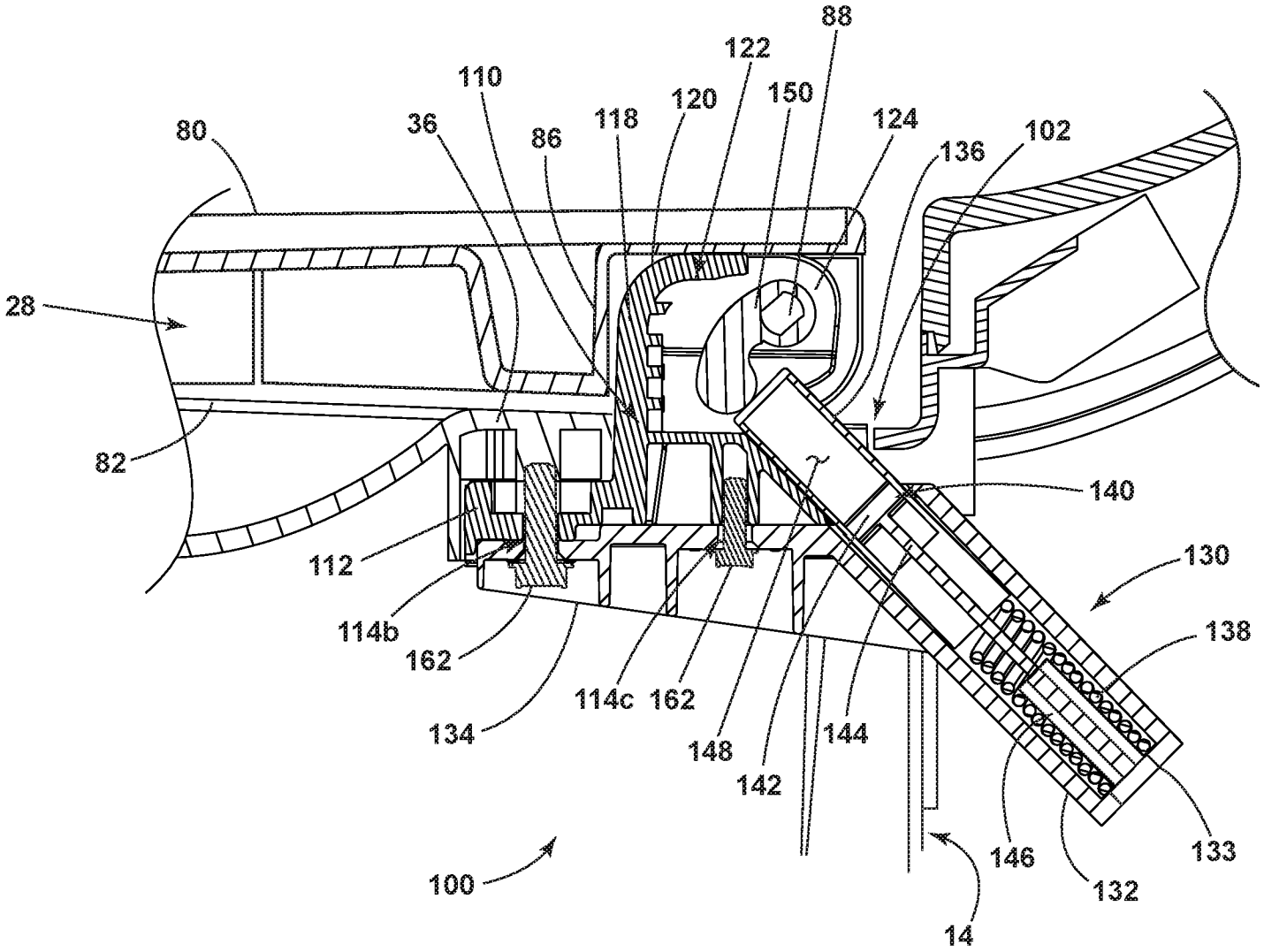
FIG. 7 is the cross-sectional view of FIG. 6 with the lid in the closed position.

The hinge cam 150 is operably coupled to the lid 28 when the lid hinge 88 is received within at least a portion of the lid hinge receiving portion 152. As there is no rotational movement between either the lid hinge 88 and the lid 28 or between the lid hinge 88 and the hinge cam 150, due to the keyed structure 160, the hinge cam 150 is thus rotationally coupled with the lid 28 such that the hinge cam 150 and the lid 28 rotate coaxially and that the hinge cam 150 is rotationally fixed relative to the lid hinge 88. More specifically, when the lid 28 is in the opened position, the hinge cam 150 is rotated to an upwardly rotated position, as shown, and when the lid 28 is in the closed position, the hinge cam 150 is rotated to a downwardly rotated position, as shown in FIG. 7. When the hinge cam 150 is coupled to the hinge portion 110, with the hinge cam 150 received within both the hinge aperture 128, and thus the inner hinge retaining structure 124, as well as the outer hinge retaining structure 126 and the hinge housing 118, the hinge cam 150 is thus rotatably coupled to the hinge housing 118 for rotation between the upwardly rotated position and the downwardly rotated position, and in turn the lid 28 is rotatably coupled to the hinge housing 118 for rotation between the opened position, corresponding to the upwardly rotated position of the hinge cam 150, and the closed position, corresponding to the downwardly rotated position of the hinge cam 150.

The biasing element 138 bears against a housing end 133 of the damper housing 132, as well as against the piston 136, so as to bias the piston 136 outwardly and upwardly from the damper housing 132, away from the housing end 133, at an angle corresponding to the non-zero angle of the damper housing 132 relative to the top panel 36, and against the hinge cam 150. The biasing of the piston 136 against the hinge cam 150, and thus against the lid hinge 88, by the biasing element 138 effectively serves to bias the hinge cam 150 to the upwardly rotated position, and thus bias the lid 28 to the opened position. However, unless the strength of the biasing element 138 were to overcome the weight of the lid 28 in the closed position, the biasing element 138 will not cause the lid 28 to be moved to the opened position without action by a user. Rather, the action of the biasing element 138 can serve to help hold the lid 28 in the opened position and to improve the ease of raising the lid 28 by the user.

The hinge assembly 100 can further comprise a damper 140. The damper 140 can be provided at least partially in between the biasing element 138 and the piston 136, such that the piston 136 is positioned between the lid hinge 88 and the damper 140, and further at least partially received within the damper housing 132 such that movement of the hinge cam 150 can selectively cause depression of the damper 140. The biasing element 138 can be positioned below the lid 28 such that the biasing element 138 can bias both the damper 140 and the piston 136 against or towards the hinge cam 150 and thus further against the lid hinge 88, and also such that the piston 136 is biased against the hinge cam 150 by both or by either of the damper 140 and the biasing element 138. The damper 140 is configured to provide damping force against the hinge cam 150 such that movement of the hinge cam 150 from the upwardly rotated position to the downwardly position, and thus also movement of the lid 28 from the opened position to the closed position, can be slowed or made smoother or softer. The damper 140 can be any suitable type of damper 140, including, by way of non-limiting example, a hydraulic damper, a piston-type damper, a frictional damper, and a ramp-type damper.

By way of non-limiting example, the damper 140 can be a hydraulic damper as illustrated herein, comprising a damper head 142 and a damper shaft 144 extending from the damper head 142 and away from the piston 136. A damper support 146 can protrude from the housing end 133, extending inwardly into the damper housing 132 to at least partially receive and to fixedly support the damper shaft 144. In one example, the damper support 146 and the damper shaft 144 can extend coaxially, and can be received within, the biasing element 138. The damper support 146 and the damper shaft 144 together fix the damper head 142 vertically or laterally relative to the damper housing 132. The piston 136 can define an interior cavity 148 that can be configured to at least partially receive the damper 140. In particular, the damper head 142 can be received within the interior cavity 148 while the damper shaft 144 extends from the piston 136 toward the housing end 133. While the damper head 142, the damper shaft 144, and the damper support 146 are fixed relative to the damper housing 132, the piston 136 and the biasing element 138 can reciprocate or be selectively compressed within the damper housing 132 and relative to the damper 140. The interior cavity 148 can be filled with a damper fluid.

As shown, with the lid 28 in the opened position, the hinge cam 150 is in the upwardly rotated position wherein the hinge cam 150 bears against the biasing surface 122 of the upper surface 120 of the hinge housing 118, which prevents further upward rotational movement of either the hinge cam 150 or the lid 28. By way of non-limiting example, the opened position of the lid 28 beyond which the lid 28 cannot rotate further due to the bearing of the hinge cam 150 against the biasing surface 122 can correspond to the lid 28 having completed 95° of rotation from the closed position to the opened position. When the hinge cam 150 is in the upwardly rotated position, the hinge cam 150 is positioned such that it does not depress the damper 140 or the piston 136. The damper 140, not depressed by the hinge cam 150 and being at least partially received within the damper housing 132, at least partially underlies the top panel 36 when the lid 28 is in the opened position. The biasing element 138 biases the piston 136 against the hinge cam 150 to a full extent such that the damper 140 is not extending the length of the interior cavity 148. Further, the piston 136 at least partially underlies the lid 28 and is positioned such that the piston 136 is not depressing the damper 140.

Referring now to FIG. 7, the hinge assembly 100 is shown coupling the lid 28 to the top panel 36, but with the lid 28 shown in the closed position. When the lid 28 is in this closed position, the hinge cam 150 is in the downwardly rotated position wherein the hinge cam 150, and specifically the cam body 154, is spaced from the biasing surface 122 and the upper surface 120. Further, in the downwardly rotated position, the hinge cam 150 is positioned such that it does depress the piston 136, and thus also the damper 140. The piston 136 still at least partially underlies the lid 28, and is further positioned such that the piston 136 compresses the biasing element 138 and reciprocates relative to the damper 140, effectively depressing the damper 140. The damper 140, being depressed by the position of the hinge cam 150 and thus also the piston 136, remains at least partially received within the damper housing 132 and at least partially underlies the top panel 36 when the lid 28 is in the closed position. The positioning of the elements of the damper 140 differs from the positioning when the lid 28 is in the opened position in that the damper 140, and in particular the damper head 142 and at least a portion of the damper shaft 144 extend at least partially along the length of the interior cavity 148.

Turning now to the operation of the lid 28 and the hinge assembly 100, the hinge assembly 100 is configured such that movement of the lid 28 from the opened position to the closed position drives rotation of the lid hinge 88 and thus also drives rotation of the hinge cam 150 from the upwardly rotated position to the downwardly rotated position. Thus, the lid hinge 88 and the hinge cam 150 are rotated to gradually depress the piston 136 and, in turn, the damper 140, and more specifically such that the downward rotation of the lid hinge 88 and the hinge cam 150 causes the piston 136 to be depressed into the damper housing 132, compressing the biasing element 138, and in turn also depressing the damper 140, when the lid 28 is moving from the opened position to the closed position. For example, when the damper 140 is a hydraulic or a fluid-filled damper, the depression of the piston 136 further into the damper housing 132 causes the piston 136 to reciprocate relative to the damper 140 such that the damper head 142 and at least a portion of the damper shaft 144 are further received within the piston 136, and specifically within the interior cavity 148. As the damper 140 moves further into the interior cavity 148, the damper head 142 compresses the fluid present within the interior cavity 148, creating a friction force and causing resistance against the movement to cause slowing or softening of the movement of the lid 28 from the opened position to the closed position.

Conversely, when a user lifts the lid 28 from the closed position to the opened position, the movement of the lid 28 drives rotation of the lid hinge 88 and thus also the hinge cam 150 from the downwardly rotated position to the upwardly rotated position. This removes the depressing force of the lid hinge 88 and the hinge cam 150 from the piston 136, as well as the damper 140, allowing the piston 136 to once again be biased against the hinge cam 150 by the biasing element 138 when the biasing force of the biasing element 138 overcomes the remaining effective weight of the lid 28. Continuing with the previous example of the hydraulic or fluid-filled damper, the rotational movement of the hinge cam 150 causes the compression of the biasing element 138 and the damper 140 by the piston 136 to be relieved, allowing re-expansion of the biasing element 138, and allowing the fluid present in the interior cavity 148 to again push the damper 140 outwardly from the interior cavity 148 of the piston 136 and back to a fully extended position as shown in FIG. 6.

In one example, certain parameters, such as the material and the weight of the lid 28, as well as the biasing force exerted by the biasing element 138 and the friction force provided by the damper 140, can be specifically selected relative to one another.

In one example, these parameters can be optimized such that the biasing force exerted by the biasing element 138 against the lid 28 via the piston 136 is not enough to overcome the weight of the lid 28 and cause the lid 28 to move from the closed position unless the lid 28 is also lifted, for example, by a user. This ensures that the lid 28 is configured to remain in the closed position unless the user specifically moves the lid 28 to the opened position and that the force of the biasing element 138 will not cause accidental opening of the lid 28 when it is not desired by the user. However, the biasing force is also selected to be sufficiently strong, such that the biasing element 138 can aid a user in easily and smoothly opening the lid 28 by providing the biasing force to the piston 136 and reducing the amount of force required to be provided by the user to lift the lid 28 relative to the force required if the biasing element 138 were not included.

The biasing element 138 can also be selected and configured to exert enough biasing force against the lid 28 to provide a damping function such that the hinge assembly 100 can act as a soft-close hinge assembly 100 for the lid 28, for example, so as to buffer or retard the speed of movement of the lid 28 from the opened position to the closed position, either due to gravity alone or due to a downward force from the user. Further, the damper 140 can provide additional damping force to the soft-close hinge assembly 100, further buffering or reducing the speed of movement of the lid 28 when it moves from the opened position to the closed position, and can be selected and configured to provide an appropriate amount of damping force for the specific weight or material of the lid 28.

By way of non-limiting example, if the lid 28 comprises a dense or heavy material, such as a metal or glass, the biasing element 138 can be provided as a stronger spring, and/or the damper 140 can be selected to be stiffer or provide an increased amount of damping force in order to avoid unintentional slamming shut of the lid 28. On the other hand, if the lid 28 comprises a fairly light or less dense material, such as composites, plastics, etc., the biasing element 138 and the damper 140 need not be as strong in order to effectively provide the soft-close function to the lid 28 and hinge assembly 100. By way of non-limiting example, if a lid 28 having a weight of 3 kilograms is provided, the damper 140 could be included, whereas the damper 140 could not be included if the lid 28 has a weight of 2 kilograms.

It is further contemplated that, while the hinge assembly 100 is illustrated herein as including the damper 140 and the piston 136, it is also within the scope of the present disclosure that the damper 140 can be omitted entirely, such that the piston 136 acting with the biasing element 138 can act as the only damper 140 within the damper housing 132 in the hinge assembly 100. Further yet, it will be understood that the damper portion 130 can be entirely omitted, with the hinge assembly 100 comprising only the hinge portion 110, which may be possible only with, for example, an ultra-light lid 28 design.

Figure 8:
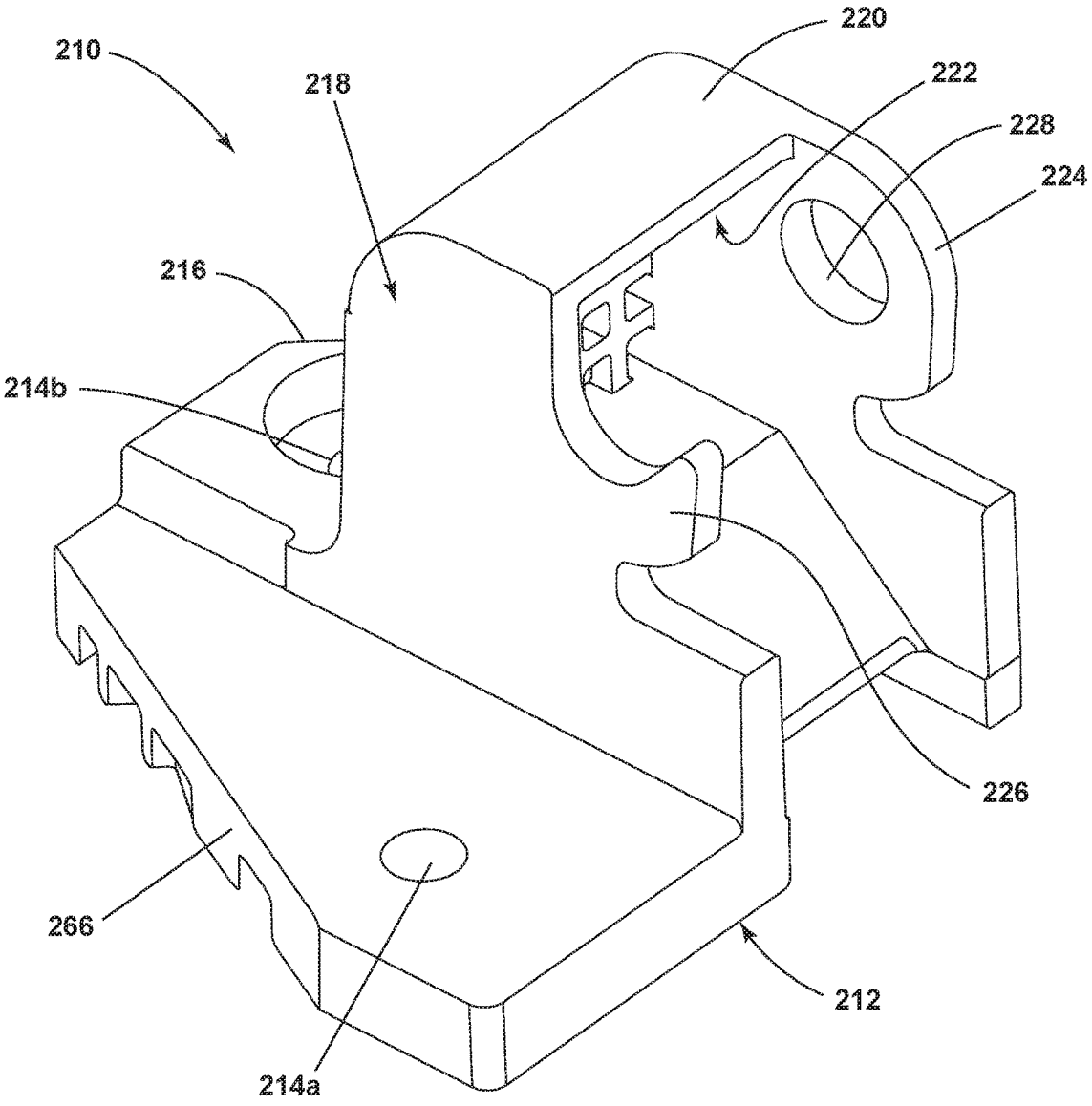
FIG. 8 is a top perspective view of another example of a hinge housing that can be provided within the hinge assembly of FIG. 3.

Referring now to FIG. 8, another example of a hinge portion 210 that can be provided within the hinge assembly 100 is illustrated. The hinge portion 210 is similar to the first hinge portion 110; therefore, like parts will be identified with numerals increased by 100, with it being understood that the description of the like parts of the first hinge portion 110 applies to the second hinge portion 210, unless otherwise noted. The hinge portion 210 can be substantially identical to the hinge portion 110, and configured to interact in the same ways with the hinge cam 150 and the damper portion 130, and also to attach to the top panel 36 in the same way as the hinge portion 110. In one example, the only difference between the hinge portion 210 and the hinge portion 110 can be that a base 212, instead of defining only one angled edge 216 adjacent a first damper fastener opening **214*b*, can further define a second angled edge 266. The second angled edge 266 can be included in the same portion of the base 212 that includes a base fastener opening 214*a* and can be adjacent the base fastener opening 214*a*. The second angled edge 266 can be included for material and cost savings, while still allowing the attachment of the hinge portion 210 to the top panel 36 in the same manner and with the same stability as that of the hinge portion 110**.

Figure 9:
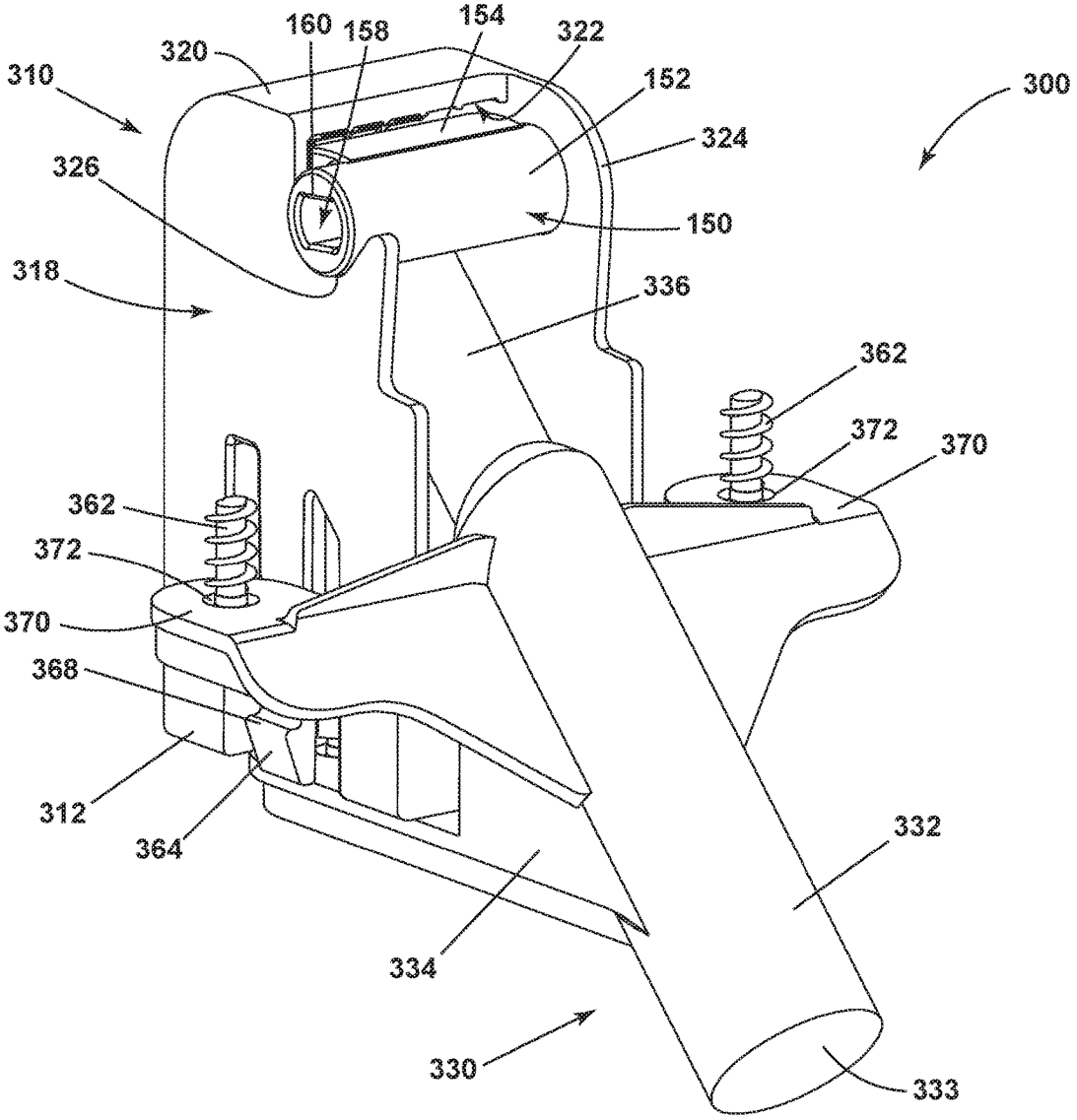
FIG. 9 is a side perspective view of another example of a hinge assembly that can be provided within the laundry treating appliance of FIG. 1.

Referring now to FIG. 9, another example of a hinge assembly 300 comprising a hinge portion 310 and a damper portion 330 is illustrated. The hinge assembly 300 is similar to the first hinge assembly 100; therefore, like parts will be identified with numerals increased by 200, with it being understood that the description of the like parts of the first hinge assembly 100 apply to the hinge assembly 300, unless otherwise noted. The hinge portion 310 can include a hinge housing 318 similar or identical to the hinge housing 118, and configured to interact in the same ways with the hinge cam 150, with the differences between the hinge portion 310 and the first hinge portion 110 being found in a base 312 portion of the hinge portion 310. Instead of the base 312 extending outwardly from a side of the hinge housing 318, as in the base 112, the base 312 defines a bottom of the hinge housing 318. Further, the base 312 can include additional features for coupling with the top panel 36, including an angled deflectable retainer 364. The angled deflectable retainer 364 can define a top surface, illustrated herein as a catch surface 368.

The damper portion 330 can include a piston 336, a damper housing 332, a damper end 333, and a mounting portion 334 substantially identical to those of the damper portion 130, with the differences from the damper portion 130 including the addition of at least one panel mounting portion 370. Each of the at least one panel mounting portion 370 defines a panel mounting opening 372 configured to receive a fastener 362 in order to couple the damper housing 332 to the top panel 36. As illustrated herein, the damper housing 332 includes two panel mounting portions 370, one extending laterally outwardly from each side of the damper housing 332, though it will be understood that only a single panel mounting portion 370 could be included, extending from either side of the damper housing 332. In one example, a portion of the mounting portion 334 that includes a first damper fastener opening 314*b* and a second damper fastener opening 314*c* (FIG. 10) can be substantially parallel to, but vertically spaced from, the panel mounting portions 370 defining the panel mounting openings 372.

Figure 10:
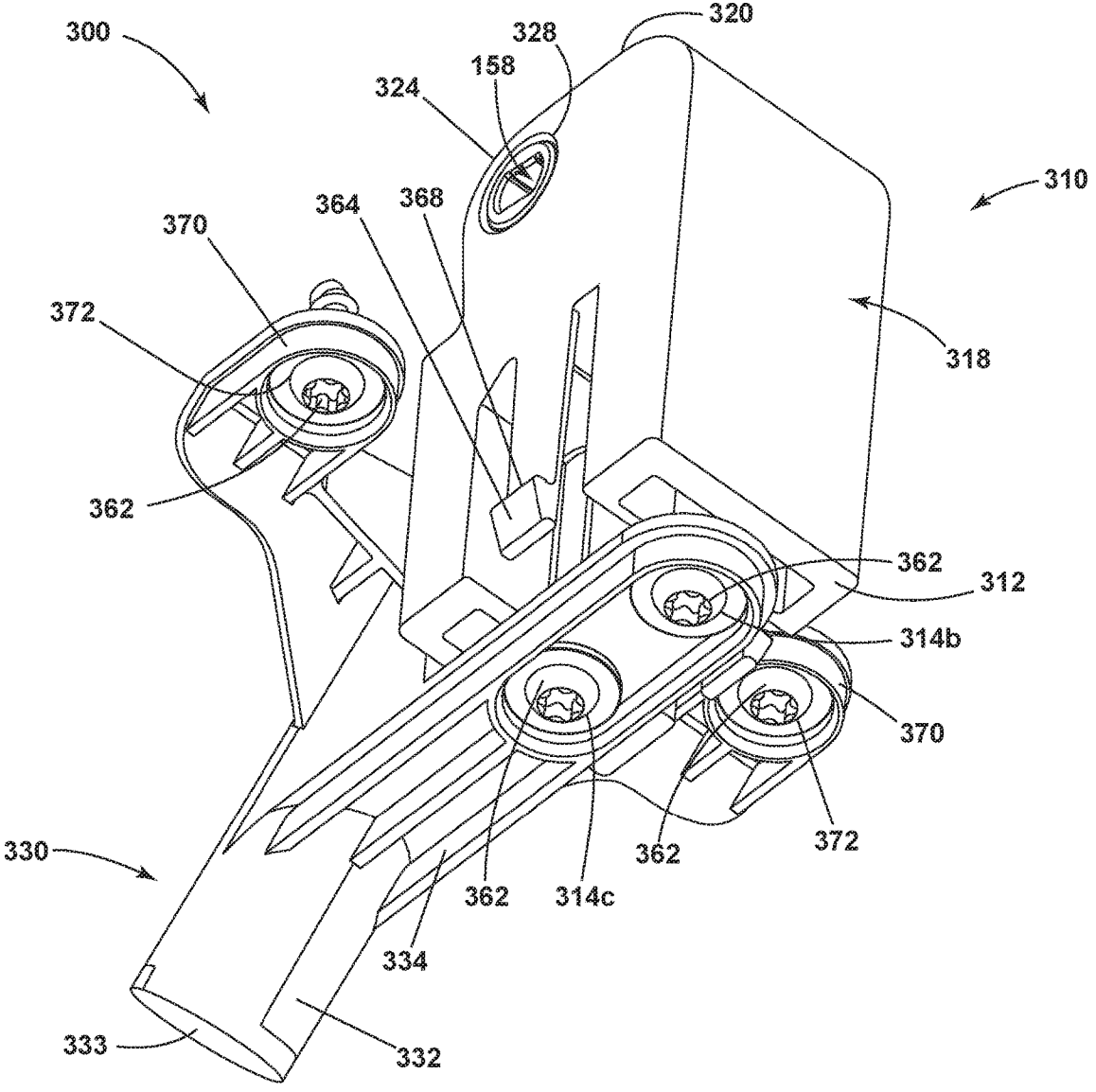
FIG. 10 is a bottom perspective view of the hinge assembly of FIG. 9.

Referring now to FIG. 10, an underside of the hinge assembly 300 shows that the mounting portion 334 is very similar to the first mounting portion 134. The mounting portion 334 defines the first damper fastener opening 314*b* and the second damper fastener opening 314*c*, each configured to receive fasteners 362 to secure the damper portion 330 to be undermounted to the hinge portion 310, and specifically to undermount the mounting portion 334 to the base 312, while the panel mounting portions 370 are undermounted to the top panel 36 by fasteners 362 received within the panel mounting openings 372.

Figure 11:
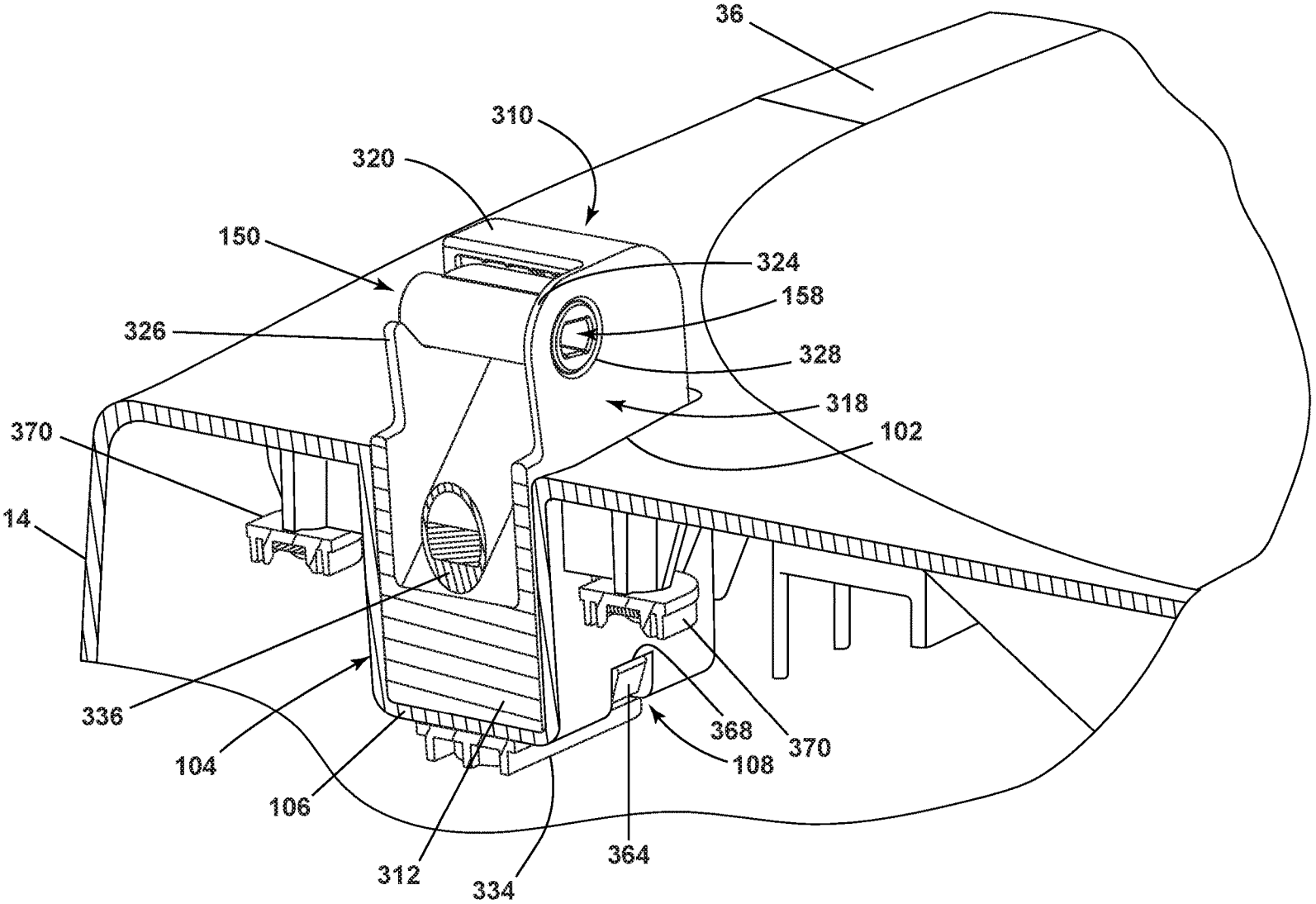
FIG. 11 is a rear cross-sectional view of the hinge assembly of FIG. 9 coupled to the cabinet of the laundry treating appliance of FIG. 1 with the lid removed.

Referring now to FIG. 11, a rear cross-sectional view illustrates the coupling of the hinge assembly 300 with the top panel 36 of the cabinet 14. The hinge portion 310 is received within the hinge opening 102, such that at least a portion of the hinge housing 318 protrudes upwardly through the hinge opening 102, above the top panel 36. In this example, the hinge opening 102 can further comprise a hinge receiving housing 104 that extends downwardly from the top panel 36 to define a housing bottom 106 upon which the hinge housing 318, and in particular the base 312, can rest when the hinge housing 318 is received within the hinge opening 102 and the hinge receiving housing 104.

The hinge receiving housing 104 can further define an opening 108 that is configured to receive the angled deflectable retainer 364 to couple the hinge housing 318 with the hinge receiving housing 104. As the hinge housing is inserted into the hinge receiving housing 104, the angled deflectable retainer 364 can be deflected laterally inward until the angled deflectable retainer 364 reaches the opening 108, at which point the angled deflectable retainer 364 can move laterally outward to return to an un-deflected position, received within the opening 108. The protrusion of the angled deflectable retainer 364, and in particular the catch surface 368, engages with the opening 108 so as to prevent upward movement of the hinge housing 318 and removal from the hinge receiving housing 104, thus resiliently coupling the hinge housing 318 with the top panel 36.

The damper portion 330 is undermounted to both the hinge portion 310 and the top panel 36 such that each of the panel mounting portions 370 are undermounted to the top panel 36. Further, the mounting portion 334 is undermounted to the base 312 of the hinge housing 318. Since the hinge housing 318 is received within the hinge receiving housing 104, the mounting portion 334 can mount to the base 312 through the housing bottom 106, such that the housing bottom 106 is positioned between the mounting portion 334 and the base 312 with the fasteners 362 extending therethrough to couple the mounting portion 334, the housing bottom 106, and the base 312 collectively.

Figure 12:
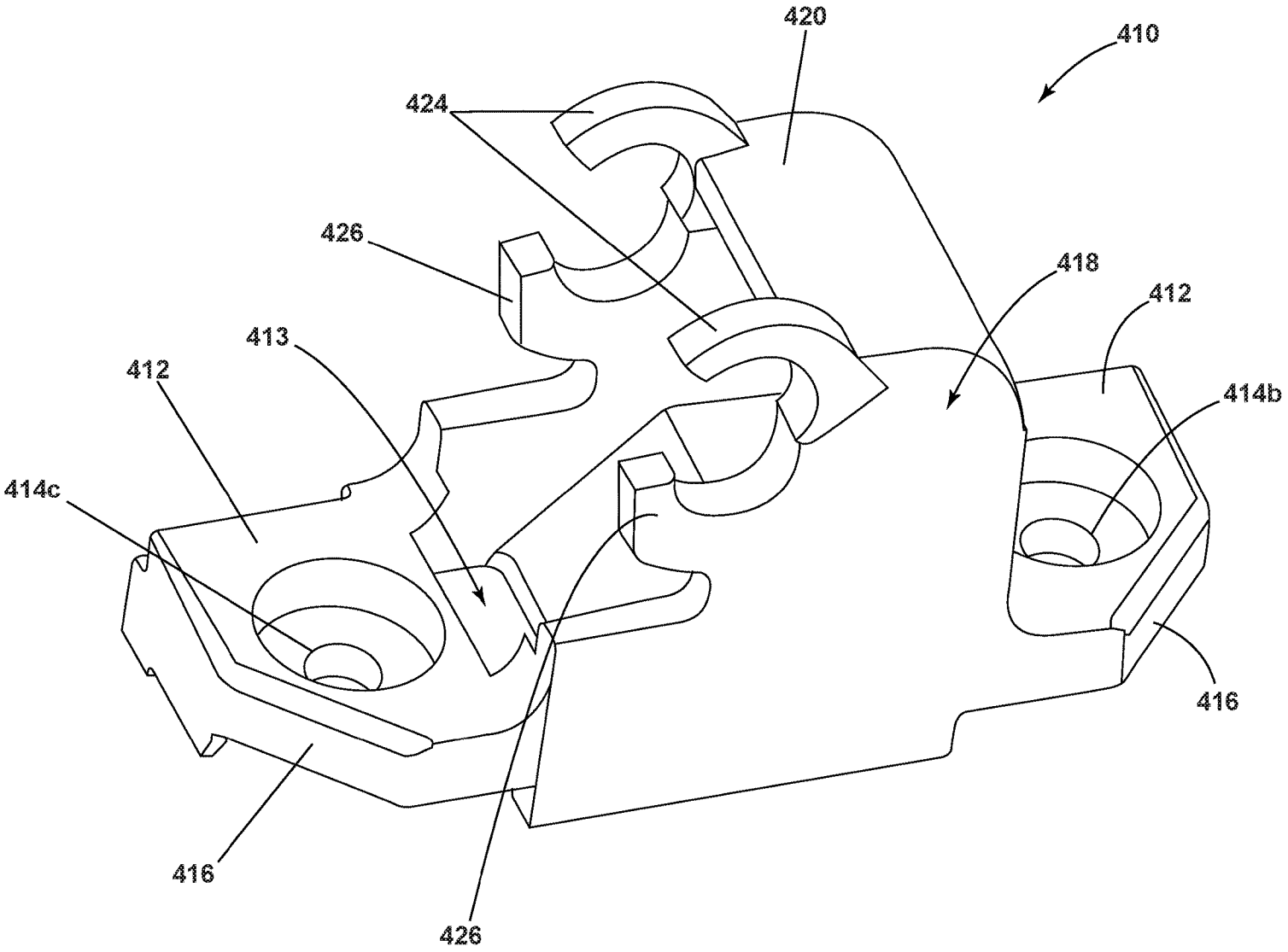
FIG. 12 is a top perspective view of yet another example of a hinge housing that can be provided within the hinge assembly of FIG. 3, the hinge housing having a retaining structure in an opened condition.

Referring now to FIG. 12, another example of a hinge portion 410 that can be used within the laundry treating appliance 10, the hinge assembly 100 or the hinge assembly 300 is illustrated. The hinge portion 410 shares similarities with the first hinge portion 110; therefore, like parts will be identified with numerals increased by 300, with it being understood that the description of the like parts of the first hinge portion 110 applies to the fourth hinge portion 410, unless otherwise noted. While the hinge assembly 100 was described as having a non-symmetrical structure and orientation, such that left and right hinge assemblies 100 could be used, but were not readily interchangeable, the hinge portion 410 is provided such that it can be used with either a left or right hinge assembly 100 interchangeably, eliminating the need for manufacturing of separate left and right hinge assemblies 100.

A base 412 can still define a first fastener opening 414*b*, analogous to the first damper fastener opening 114*b* and having an angled edge 416 adjacent. However, instead of the base 412 extending in a direction that is laterally outward from a hinge housing 418 and from the damper housing 132, as the base 112 does, the base 412 additionally extends from the hinge housing 418 in a direction opposite from the portion of the base 412 that defines the first fastener opening 414*b* and the angled edge 416, in a position such that it would further overlie the damper housing 132. In this case, the base 412 defines a piston opening 413 through which the piston 136 could extend from below the hinge housing 318. The portion of the base 412 beyond the piston opening 413, and opposite the first fastener opening 414*b* can further define a second fastener opening 414*c*, analogous to the first damper fastener opening 114*b*, as well as further defining another angled edge 416 adjacent the second fastener opening 414*c*.

The hinge housing 318 can include another difference from the hinge housings 118, 218, 318, which is seen in the structure of hinge retaining structures, illustrated herein as lower hinge retaining structures 426 and upper hinge retaining structures 424. In this example, in order to provide a hinge housing 418 that is the same between left and right hinge assemblies 100, the lower hinge retaining structures 426 and upper hinge retaining structures 424 can be identical at either side of the hinge housing 418. The lower hinge retaining structures 426 can both comprise a portion of a sidewall of the hinge housing 418 and are stationary relative to the hinge housing 418, having a structure analogous to the outer hinge retaining structure 126, such that the lower hinge retaining structures 426 define a support having an open top to partially receive the hinge cam 150 such that the hinge cam 150 can rest upon the lower hinge retaining structures 426. The upper hinge retaining structures 424 can be movably coupled to the hinge housing 418 so as to be movable relative to the lower hinge retaining structures 424 between an opened position as shown and a closed position (FIG. 13) to selectively retain the hinge cam 150 and the lid hinge 88.

Figure 13:
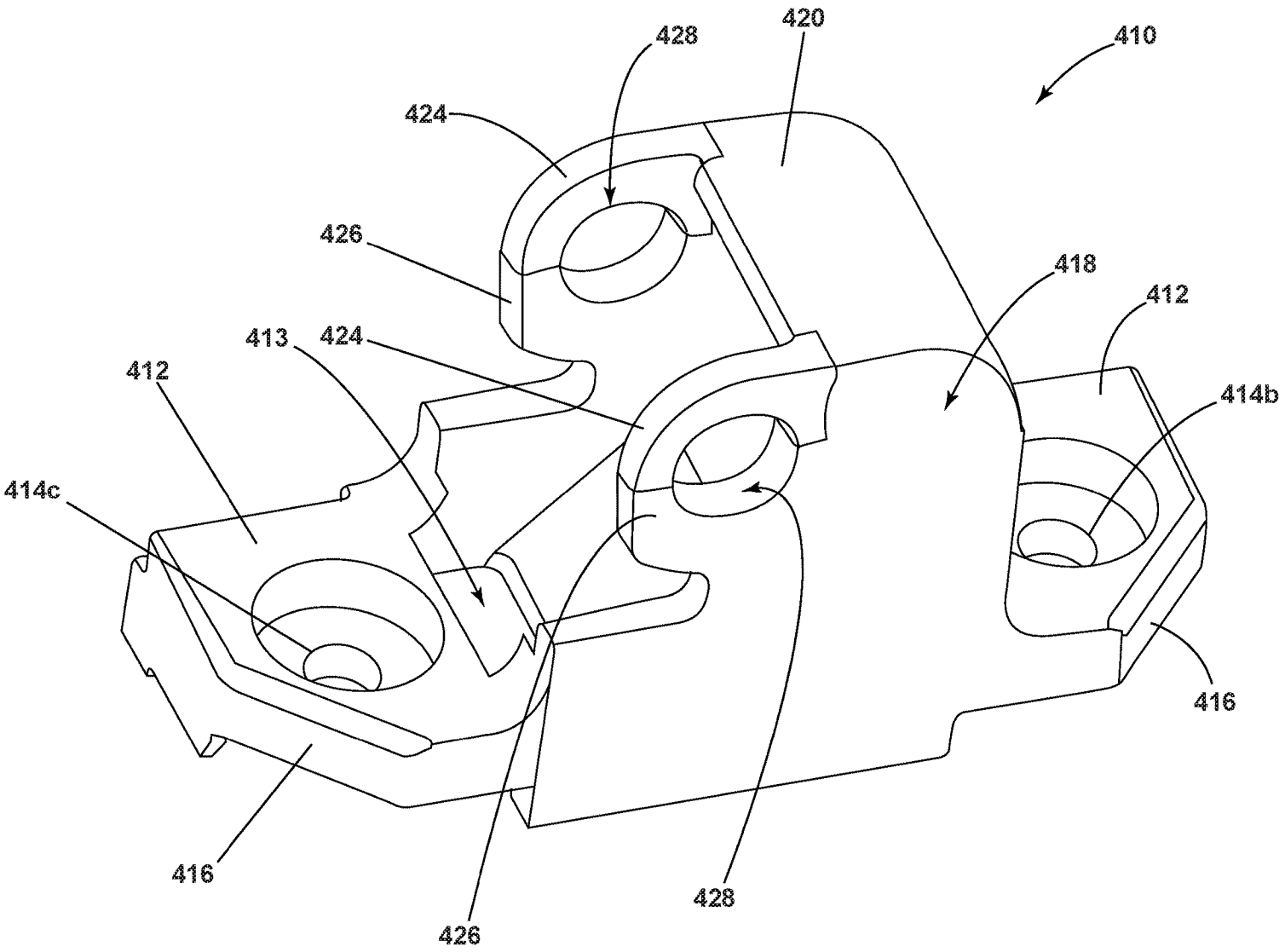
FIG. 13 is a top perspective view of the hinge housing of FIG. 12 having the retaining structure in a closed condition.

In FIG. 13, the lower hinge retaining structures 424 are in their closed position relative to the lower hinge retaining structures 424 to define hinge apertures 428 for retaining the hinge cam 150 and lid hinge 88. In one example, the upper hinge retaining structures 424 can be provided in the opened position when manufactured, and can be moved to the closed position during assembly with the laundry treating appliance 10, such that, once the hinge cam 150 and lid hinge 88 are in position and received by the lower hinge retaining structures 426, the upper hinge retaining structures 424 can be rotated or pivoted downwardly to the closed position to form the hinge apertures 428. It is contemplated that the upper hinge retaining structures 424 can be provided as snap-fit structures such that they snap into place when moved to the closed position and can no longer be moved back from the closed position to the opened position, ensuring that the hinge cam 150 and lid hinge 88 remain resiliently retained by the hinge housing 318 once the laundry treating appliance 10 has been assembled for use.

The aspects of the present disclosure described herein set forth a laundry treating appliance having a lid with a hinge assembly that can be a soft-close hinge assembly to provide ease of use to a user both in opening the lid by biasing the lid to the opened position once it has been opened, and in providing damping effects to facilitate a soft closing of the lid, rather than a lid that slams shut, which can be particularly desirable when it is desired to use, for example, a glass lid, that may be more fragile than other lid materials. The hinge assemblies disclosed herein also offer improved flexibility in that they can be used with a variety of lid types and materials, including steel lids, glass lids, plastic lids, or lids with a combination of materials and components. In addition, by positioning the damper housing at an angle relative to the hinge housing, the top panel, and the lid, a compact design is provided to save space within the laundry treating appliance and also to allow use of the hinge assembly with a variety of lid types, such as an edge-to-edge lid instead of only a traditional lid recessed into the top panel. The examples of the hinge assemblies and damper housings can also make it possible to retrofit a soft-close damper housing to a hinge assembly that may not have included a soft-close damper before, or to provide hinge assemblies that are not distinct between left and right, such that they can be used at either edge of a lid, improving ease of manufacturing and assembly, as well as cost savings due to reduced materials usage.

To the extent not already described, the different features and structures of the various aspects can be used in combination with each other as desired. That one feature may not be illustrated in all of the aspects of the disclosure is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While the aspects of the present disclosure have been specifically described in connection with certain specific details thereof, it is to be understood that this is by way of illustration and not of limitation. Reasonable variation and modification are possible within the scope of the forgoing disclosure and drawings without departing from the spirit of the present disclosure, which is defined in the appended claims. Hence, specific dimensions and other physical characteristics relating to the aspects of the present disclosure are not to be considered as limiting, unless expressly stated otherwise.

What is claimed is:

1. A laundry treating appliance for treating laundry items according to an automatic cycle of operation, the laundry treating appliance comprising:

a cabinet defining an interior and having a top panel that at least partially defines an access opening to the interior;

a lid rotatable between a closed position and an opened position to selectively open or close the access opening; and at least one hinge assembly coupling the top panel with the lid, the at least one hinge assembly comprising:

a hinge housing coupled to the top panel;

a cam received within the hinge housing and coupled to the lid;

a snubber housing coupled to the hinge housing and having a damper receiving portion provided at an angle between 20 to 80 degrees relative to the top panel in the closed position; and a damper at least partially received within the damper receiving portion and biased against the cam such that movement of the cam selectively depresses the damper when the lid moves from the opened position to the closed position.

2. The laundry treating appliance of claim 1 wherein the cam is rotatably coupled to the hinge housing between an upwardly rotated position and a downwardly rotated position.

3. The laundry treating appliance of claim 2 wherein the cam bears against an upper surface of the hinge housing in the upwardly rotated position.

4. The laundry treating appliance of claim 3 wherein the cam is spaced from the upper surface of the hinge housing in the downwardly rotated position.

5. The laundry treating appliance of claim 4 wherein the cam rotates coaxially with the lid.

6. The laundry treating appliance of claim 4 wherein the cam is in the upwardly rotated position when the lid is in the opened position and the cam in the upwardly rotated position does not depress the damper.

7. The laundry treating appliance of claim 6 wherein the cam is in the downwardly rotated position when the lid is in the closed position and the cam in the downwardly rotated position depresses the damper.

8. The laundry treating appliance of claim 1 wherein the lid extends across a full width of the top panel.

9. The laundry treating appliance of claim 1 wherein the at least one hinge assembly is a soft-close hinge assembly.

10. The laundry treating appliance of claim 1 wherein the laundry treating appliance is a vertical axis laundry treating appliance with the lid positioned above the top panel.

11. A laundry treating appliance for treating laundry items according to an automatic cycle of operation, the laundry treating appliance comprising:

a cabinet defining an interior and having a top panel that at least partially defines an access opening to the interior;

a lid rotatable between a closed position and an opened position to selectively open or close the access opening; and at least one hinge assembly coupling the top panel with the lid, the at least one hinge assembly comprising:

a hinge housing coupled to the top panel;

a cam received within the hinge housing and coupled to the lid;

a snubber housing coupled to the hinge housing and having a damper receiving portion provided at an angle between 20 to 80 degrees relative to the top panel in the closed position;

a damper at least partially received within the damper receiving portion and at least partially underlying the top panel when the lid is in the opened position;

a piston provided between the cam and the damper and at least partially underlying the lid when the lid is in the opened position, the piston biased against the cam by the damper such that movement of the cam causes the piston to selectively depress the damper when the lid moves from the opened position to the closed position.

12. The laundry treating appliance of claim 11 wherein the cam is rotatably coupled to the hinge housing between an upwardly rotated position and a downwardly rotated position.

13. The laundry treating appliance of claim 12 wherein the cam bears against an upper surface of the hinge housing in the upwardly rotated position.

14. The laundry treating appliance of claim 13 wherein the cam is spaced from the upper surface of the hinge housing in the downwardly rotated position.

15. The laundry treating appliance of claim 14 wherein the cam rotates coaxially with the lid.

16. The laundry treating appliance of claim 14 wherein the cam is in the upwardly rotated position when the lid is in the opened position and the cam in the upwardly rotated position does not depress the damper.

17. The laundry treating appliance of claim 16 wherein the cam is in the downwardly rotated position when the lid is in the closed position and the cam in the downwardly rotated position depresses the damper.

18. The laundry treating appliance of claim 11 wherein the lid extends across a full width of the top panel.

19. The laundry treating appliance of claim 11 wherein the laundry treating appliance is a vertical axis laundry treating appliance with the lid positioned above the top panel.

* * * * *